US007341028B2

(12) United States Patent
Klose et al.

(10) Patent No.: US 7,341,028 B2
(45) Date of Patent: Mar. 11, 2008

(54) HYDRAULIC VALVE ACTUATION SYSTEMS AND METHODS TO PROVIDE MULTIPLE LIFTS FOR ONE OR MORE ENGINE AIR VALVES

(75) Inventors: Charles Conrad Klose, Plainfield, IL (US); Randall James Strauss, Colorado Springs, CO (US); Oded Eddie Sturman, Woodland Park, CO (US); James A. Peña, Encinitas, CA (US)

(73) Assignee: Sturman Industries, Inc., Woodland Park, CO (US)

( * ) Notice: Subject to any disclaimer, the term of this patent is extended or adjusted under 35 U.S.C. 154(b) by 327 days.

(21) Appl. No.: 11/081,257

(22) Filed: Mar. 15, 2005

(65) Prior Publication Data

US 2005/0211201 A1 Sep. 29, 2005

Related U.S. Application Data

(60) Provisional application No. 60/553,325, filed on Mar. 15, 2004.

(51) Int. Cl.
*F01L 9/02* (2006.01)

(52) U.S. Cl. ..... 123/90.12; 123/90.13

(58) Field of Classification Search ..... 123/90.12, 123/90.13

See application file for complete search history.

(56) References Cited

U.S. PATENT DOCUMENTS 3,209,737 A 10/1965 Omotehara et al.
4,821,689 A 4/1989 Tittizer et al.
5,048,489 A 9/1991 Fischer et al.
5,241,935 A * 9/1993 Beck et al. ..... 123/300
5,463,987 A 11/1995 Cukovich
5,598,871 A 2/1997 Sturman et al.
5,638,781 A 6/1997 Sturman
5,640,987 A 6/1997 Sturman
5,713,315 A 2/1998 Jyoutaki et al.
5,713,316 A 2/1998 Sturman
5,829,396 A 11/1998 Sturman (Continued)

FOREIGN PATENT DOCUMENTS

WO WO - 02/46582 A2 6/2002

OTHER PUBLICATIONS

Misovec, Kathleen M., et al., "Digital Valve Technology Applied to the Control of an Hydraulic Valve Actuator", SAE Technical Paper 1999-01-0825, Mar. 1-4, 1999, International Congress and Exposition, Detroit, Michigan.

(Continued)

*Primary Examiner*—Ching Chang
(74) *Attorney, Agent, or Firm*—Blakely Sokoloff Taylor & Zafman LLP

(57) ABSTRACT

Hydraulic valve actuation systems and methods to provide multiple lifts for engine valves using fixed or hard stops at each lift. The fixed or hard stops provide a very repeatable selection of engine valve lifts dependent on engine operating conditions. For full valve lift, unidirectional hydraulic dashpots are used to decelerate the engine valve, both as it approaches the full lift fixed stop, and as the engine valve approaches the valve seat from the engine valve full lift position. Various embodiments and methods of operation are disclosed.

10 Claims, 6 Drawing Sheets

U.S. PATENT DOCUMENTS

| | | | | |
|---|---|---|---|---|
| 5,960,753 | A | 10/1999 | Sturman | |
| 5,970,956 | A | 10/1999 | Sturman | |
| 6,109,284 | A | 8/2000 | Johnson et al. | |
| 6,148,778 | A | 11/2000 | Sturman | |
| 6,173,685 | B1 | 1/2001 | Sturman | |
| 6,308,690 | B1 | 10/2001 | Sturman | |
| 6,340,009 | B1 | 1/2002 | Boecking | |
| 6,360,728 | B1 | 3/2002 | Sturman | |
| 6,374,784 | B1 | 4/2002 | Tischer et al. | |
| 6,415,749 | B1 | 7/2002 | Sturman et al. | |
| 6,505,584 | B2 * | 1/2003 | Lou | 123/90.12 |
| 6,557,506 | B2 | 5/2003 | Sturman | |
| 6,575,126 | B2 | 6/2003 | Sturman | |
| 6,584,885 | B2 * | 7/2003 | Lou | 92/60 |
| 6,668,773 | B2 | 12/2003 | Holtman et al. | |
| 6,739,293 | B2 | 5/2004 | Turner et al. | |
| 6,886,511 | B1 | 5/2005 | Tong et al. | |

OTHER PUBLICATIONS

Tai, Chun, et al., "Using Camless Valvetrain for Air Hybrid Optimization", SAE Technical Paper 2003-01-0038, Mar. 2003, SAE 2003 World Congress & Exhibition, Detroit, Michigan.

Klose, Charles, "Sturman HVA-4D System", SAE 2004, Mar. 8-11, 2004.

* cited by examiner

HYDRAULIC VALVE ACTUATION SYSTEMS AND METHODS TO PROVIDE MULTIPLE LIFTS FOR ONE OR MORE ENGINE AIR VALVES

CROSS-REFERENCE TO RELATED APPLICATION

This application claims the benefit of U.S. Provisional Patent Application No. 60/553,325 filed Mar. 15, 2004.

BACKGROUND OF THE INVENTION

1. Field of the Invention

The present invention relates to the field of piston engines.

2. Prior Art

Historically, piston engines have used mechanically actuated poppet type intake and exhaust valves operated by way of an engine driven camshaft. While such systems are in a high state of development and usually provide reliable performance for the life of the engine, they have the disadvantage of providing a fixed relationship between crankshaft angle and valve position. Accordingly, the timing for valve opening and closing, the valve lift obtained, etc., are predetermined and fixed throughout the operating range of the engine, thus providing a substantial engine performance compromise under most engine operating conditions.

More recently, considerable work has been done in the development of alternate engine valve actuation systems, generally with a goal of allowing the varying of valve opening and closing crankshaft angle with varying engine operating conditions, and in some cases, of varying the valve lift based on engine operating conditions. One such alternate actuation system comprises hydraulic valve actuation using a spring return, a hydraulic return, or a combination of both. Generally, such valve actuation systems use either a single stage or a two-stage electrically controlled valving system for operation of the hydraulic actuator, the valving system being operative between three states, the first coupling the hydraulic actuator to a source of hydraulic fluid under pressure, the second blocking hydraulic fluid communication to or from the hydraulic engine valve actuator, and the third coupling the hydraulic engine valve actuator to a low pressure drain or vent. Thus engine valve lift may be controlled by controlling the timing between initiating valve opening by coupling the hydraulic engine valve actuator to the source of fluid under pressure and the blocking of the flow of hydraulic fluid to or from the hydraulic engine valve actuator. This, in theory, provides the desired result, though in practice may not provide the accuracy and uniformity in valve lift desired for smooth engine operation under all conditions.

Systems are also known for controlling the valving based on actual measurement of valve position. This has certain advantages, but also adds to the complexity of the system.

DETAILED DESCRIPTION OF THE PREFERRED EMBODIMENTS

One aspect of the present invention is an engine valve hydraulic actuation system allowing a selection of valve lifts, each being determined by a fixed stop, thereby providing excellent repeatability in valve lift. Another aspect of the present invention provides hydraulic deceleration or braking of engine valve velocity, not only on engine valve closure but also at attainment of higher lift or lifts. Thus, by way of example, in a diesel engine while idling or when running at low load and low rpm, the intake valve or valves, or intake and exhaust valves, may be operated with the lower lift, thereby providing adequate aspiration while at the same time reducing the hydraulic energy used for engine valve actuation. By way of another example, in engines having multiple intake valves such as two per cylinder, one intake valve might be opened to a high lift and the other intake valve opened to a low lift to increase turbulence within the combustion chamber for better mixing of the fuel and air charge. In the embodiments to be described herein, systems for the choice of two engine valve lifts are described, though the concept is readily extendable to more than two engine valve lifts, if desired. The hydraulic fluid used may be engine oil, fuel or some third fluid, as desired.

Figure 1:
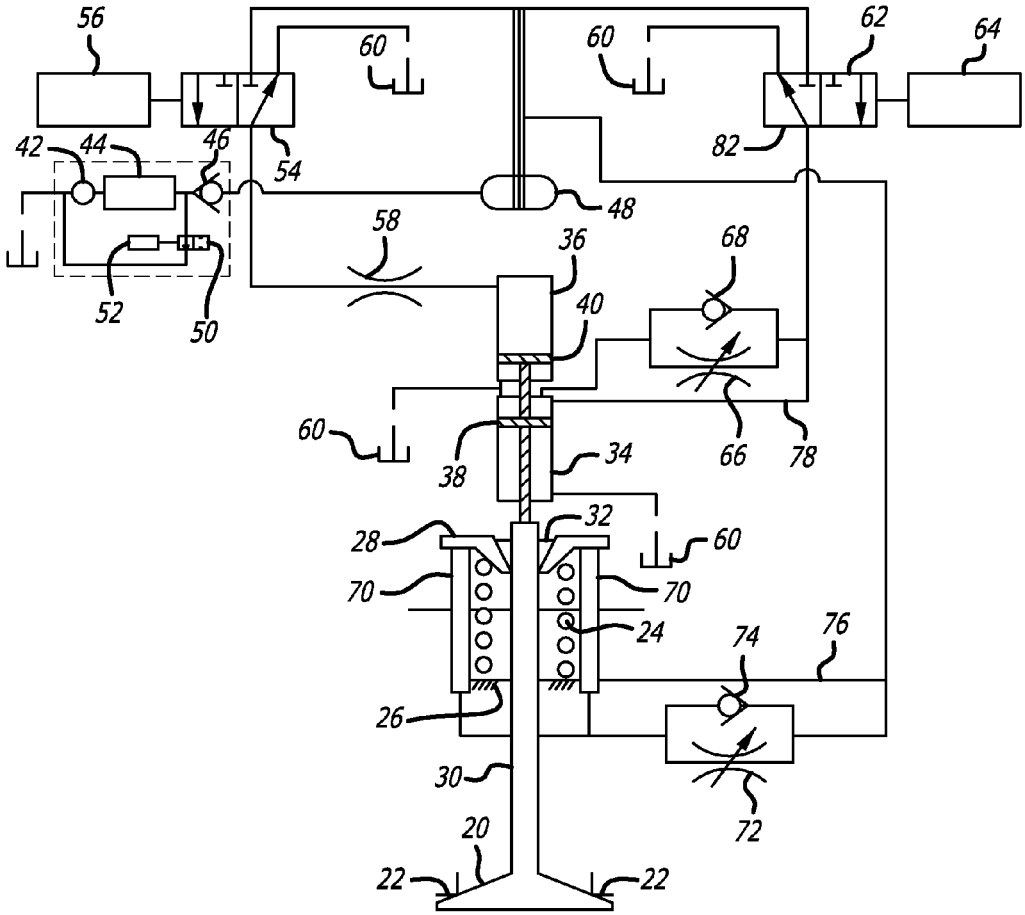
FIG. 1 is a schematic diagram of one embodiment of the present invention.

One embodiment of the present invention is shown schematically in FIG. 1. Shown therein is an engine valve 20 in the closed position resting on valve seat 22, shown particularly schematically. The engine valve 20 is encouraged to this closed position by return spring 24 acting between the engine head 26 and member 28 coupled to the valve stem 30 by keepers 32 of the type well known in the art. When the engine is running, the engine valve is also encouraged to the closed position by hydraulic pressure acting on the bottom of pins 70. Above the top of valve stem 30 are cylinders 34 and 36 in which independent pistons 38 and 40 are disposed. Piston 40 has specifically limited travel in comparison to piston 38, so that when piston 40 is forced to its lowermost position by pressure of hydraulic fluid over the piston 40, a first valve lift for valve 20 is defined. However, when piston 38 is forced downward by hydraulic pressure over the piston, a second greater valve lift is defined, as shall be subsequently described in greater detail. In an actual embodiment, described later herein, the two pistons 38 and 40 are concentric, piston 38 being of smaller diameter and fitting within piston 40.

Hydraulic pressure is provided for the system of this embodiment by a positive displacement pump 42, pumping through a kidney or manifold arrangement 44 and through a check valve 46 to a high pressure rail 48, which may be a fixed pressure rail, or a variable pressure high pressure rail.

Pressure in the high pressure rail 48 is controlled by a bypass valve 50, electrically controlled by an actuator 52 to couple the output of the positive displacement pump 42 back to the input of the pump as required to balance pump output with hydraulic system usage.

Pressure over piston 40 is controlled in this embodiment by three-way valve 54, actuated by one or more actuators 56. Valve 54 controllably couples pressure from the high pressure rail 48 through restriction 58 to the region over piston 40, or alternatively, couples the region over piston 40 through restriction 58 to vent 60. In one preferred embodiment, valve 54 is a three-way spool valve using an integral single coil, spring return actuator. However, other types of actuators, such as dual coil magnetic latching actuators, etc., as well as other types of valve, such as poppet valves may be used. In that regard, two two-way valves could be used in place of the single three-way valve 54 if desired.

An identical or similar valve 62 is used to control pressure over piston 38, the valve being controlled by an actuator or actuators 64. In this embodiment valve 62, when coupling hydraulic fluid from the high pressure rail 48 to the region over piston 38, couples that high pressure hydraulic fluid through restriction 66 and check valve 68.

The system operates as follows. With no pressure in the system, return spring 24 assures that the valve 20 (all valves in the engine) are closed. As pressure builds in the high pressure rail 48, the closing force of the return spring 24 is aided by the coupling of the pressure in the high pressure rail to the region below pins 70, which also encourage member 28, and thus valve 20, upward to the closed position. Pressure from the high pressure rail is provided under pins 70 through a restriction 72 and a check valve 74. When the valve 20 is to be opened to the first, lower lift, valve 54 is actuated to couple pressure in the high pressure rail 48 through restriction 58 to the region over piston 40. Restriction 58 provides some restriction on the valve opening velocity, though since the valve lift itself is substantially restricted, sufficiently short engine valve opening times are still achieved for all engine operating conditions. Then when the engine valve 20 is to be closed, valve 54 is switched back to the position shown, venting the region above piston 40 through restriction 58 to the vent or drain 60. Restriction 58 again restricts the engine valve closing velocity, and particularly the landing velocity, yet because of the limited lift used for this first lift position, adequately fast engine valve closing times are achieved for all engine operating conditions. Preferably the vent or drain 60 is at an adequate pressure to assure backfilling of any increasing volumes in the system with hydraulic fluid during operation of the system.

When the engine valve is to be opened to the greater lift position, valve 62 may be operated to couple the region over piston 38 to the high pressure rail 48 through restriction 66 and check valve 68, which opens to allow free flow of the high pressure fluid to the region over piston 38. As the engine valve moves downward, so do member 28 and pins 70, which are substantially smaller in total cross-sectional area than piston 38 or 40. Accordingly, the high pressure fluid under pins 70 is initially returned to the high pressure rail through line 76. However, as the lower ends of pins 70 pass the opening for line 76, the pins close off that opening so that the pressure below pins 70 rises above that of the high pressure rail. This closes check valve 74, with the further flow of hydraulic fluid through restriction 72 providing a dashpot type action to slow the engine valve opening to a soft landing, in the embodiment shown as limited by the total stroke of pins 70. The pins 70 could provide a hard or fixed stop associated with the actuator providing the second or larger lift. In a preferred embodiment to be described, a different hard stop is provided just before the pins 70 reach their lowermost limit.

Now when the engine valve 20 is to be closed from the higher lift position, valve 62 is moved to the position shown to couple the region over piston 38 to the low pressure drain or vent 60. Now high pressure fluid from the high pressure rail will be provided through now open check valve 74 and soon also through line 76, with the combination of pins 70 and return spring 74 accelerating the engine valve toward the engine valve closed position. As the engine valve starts to close, the region above piston 38 is vented through line 78, as well as restriction 66, to vent or drain 60. However, as piston 38 moves above the port to line 78, flow through that line is blocked, with pressure above piston 38 rising above the vent or drain pressure, closing check valve 68 to allow flow now only through restriction 66, thereby also providing a form of dashpot effective on final closing of the engine valve 20. Thus in this embodiment, one may select either of two engine valve lifts, and for the greater engine valve lift, unidirectional dashpot type damping is provided not only as the engine valve approaches the closed position, but also as the engine valve approaches the fixed or hard stop open position, the dashpots not limiting acceleration of the engine valve either from the closed position toward the open position, or from the fully open position toward the closed position.

Figure 2:
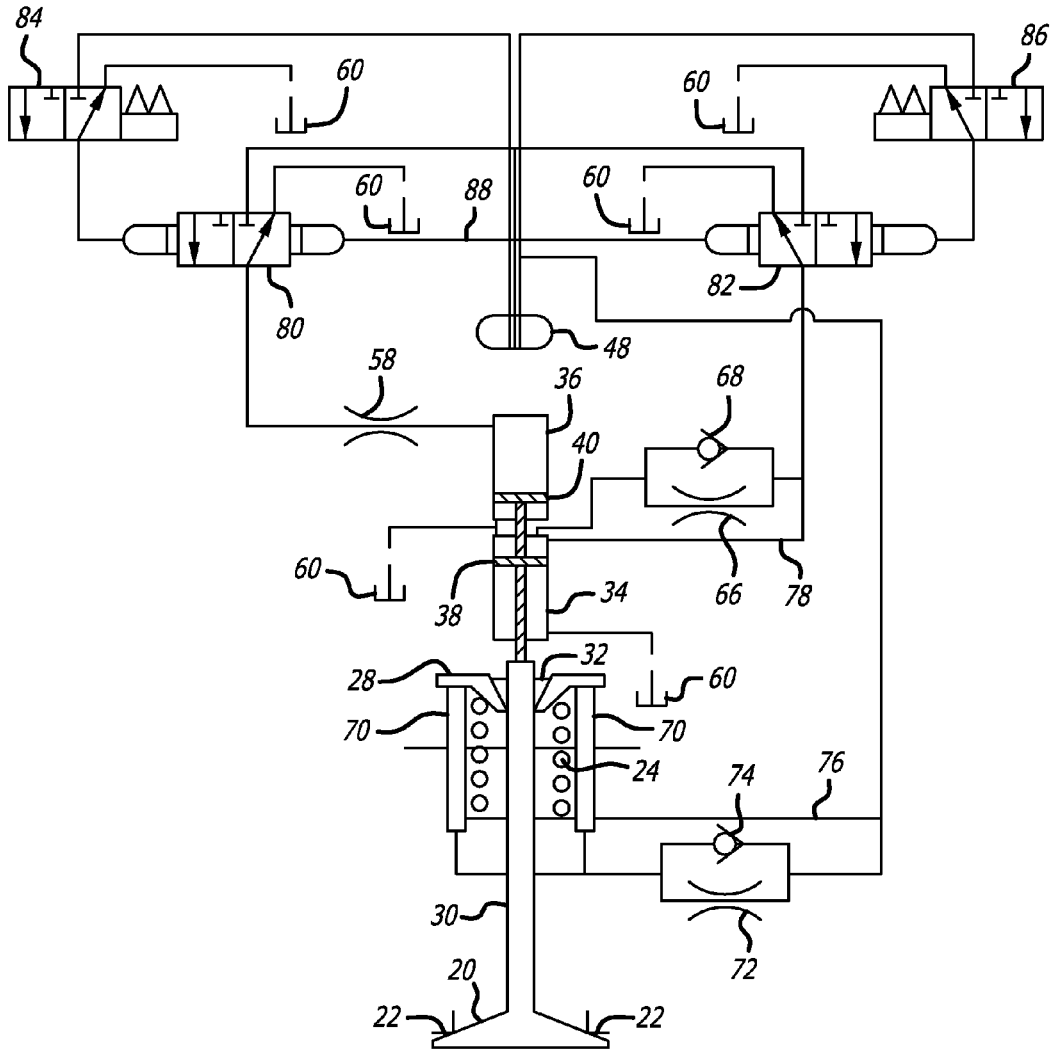
FIG. 2 is a schematic diagram of an alternate embodiment of the present invention.

Another embodiment of the present invention is shown in FIG. 2. This embodiment is the same as the embodiment shown in FIG. 1, with the exception of valves 54 and 62. Instead, valves 80 and 82 are provided, these valves being hydraulically actuated three-way valves, specifically in this embodiment being three-way spool valves, controlled by three-way control valves 84 and 86. The three-way control valves 84 and 86 may be any of various types, like valves 54 and 62 of FIG. 1, or alternatively two, two way valves. In the embodiment shown, the spools of the three-way spool valves 80 and 82 have a hydraulic spool return provided through line 88 between the high pressure rail 48 and relatively small pistons at one end of the spools, which force may be overcome by the coupling of pressure from the high pressure rail through valves 84 and 86 to larger piston areas at opposite ends of the spools in spool valves 80 and 82. Thus in this embodiment, two stage control of the two engine valve lifts are provided, whereas in the embodiment of FIG. 1, single stage control is provided. If desired, a spring may also be provided at one end of the spool to predetermine the spool position associated with the engine valve closed state when there is no hydraulic pressure.

Figure 3:
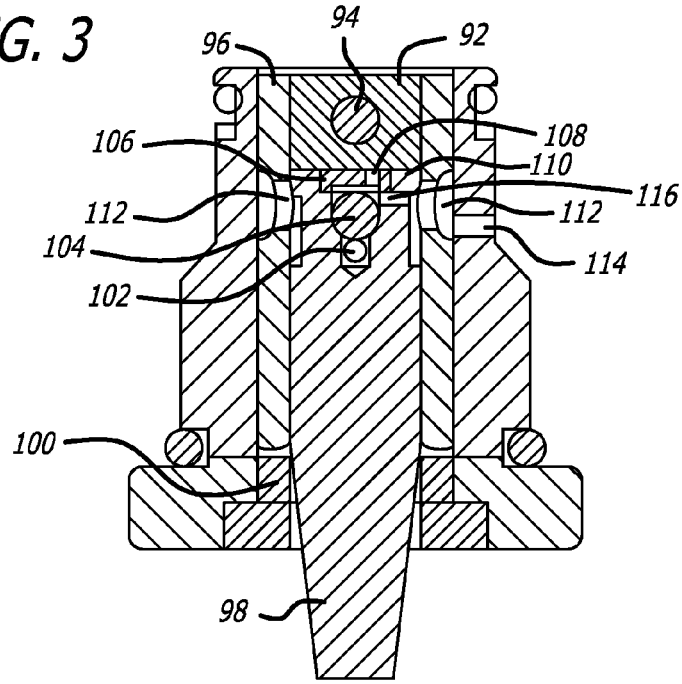
FIG. 3 is an illustration of concentric piston engine valve actuators that may be used as a variation of the embodiments of FIGS. 1 and 2.
Figure 4:
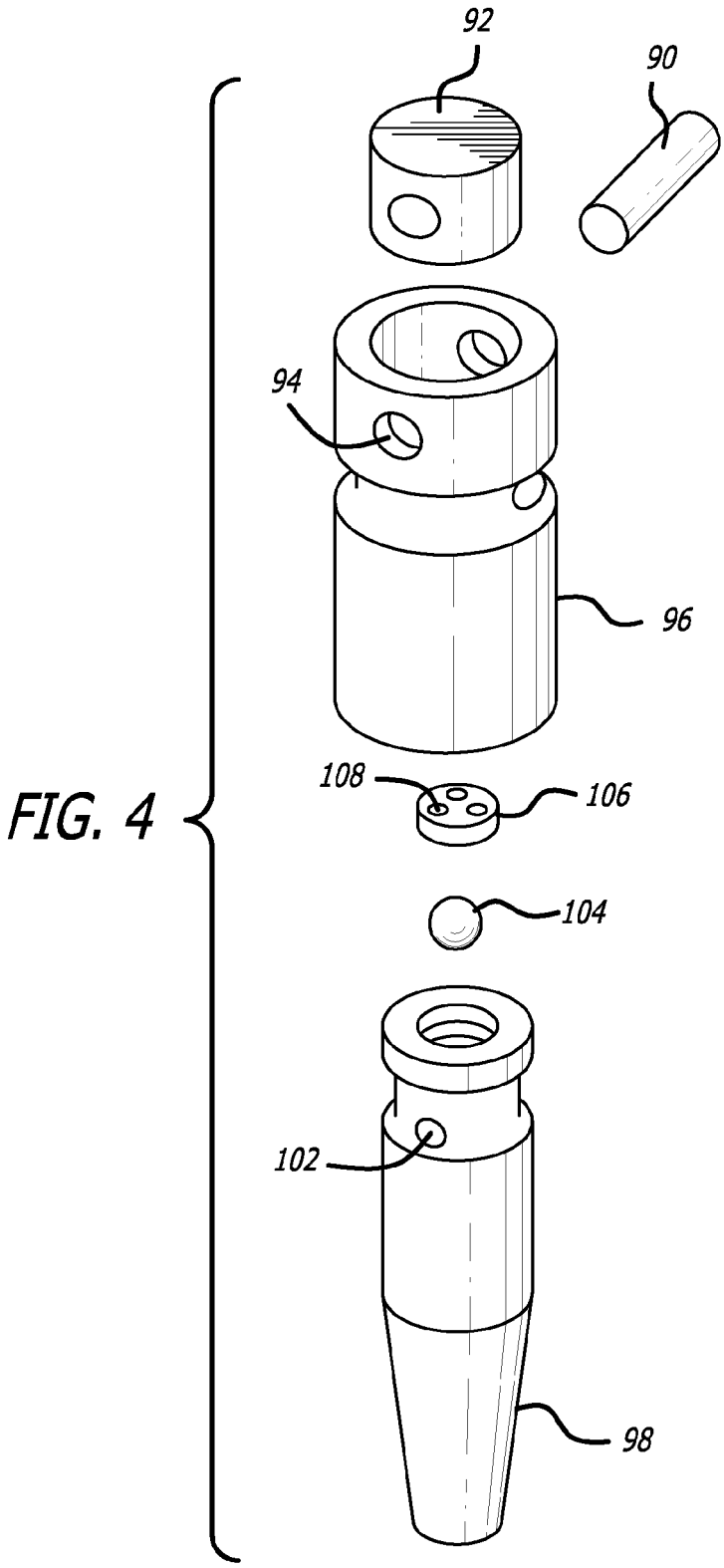
FIG. 4 is an exploded view of the concentric piston engine valve actuator of FIG. 3.

In the embodiments heretofore disclosed, two independent pistons are shown schematically, one on top of the other, one piston having a limited stroke with the stroke of the second piston being limited by the allowable stroke of the engine valve hydraulic return pins 70. While such a series arrangement of actuator pistons could be used, a more attractive packaging of a dual piston arrangement is by way of concentric or parallel pistons. Such an arrangement is shown in FIGS. 3 and 4, FIG. 3 being a cross-section of the piston assembly and FIG. 4 being an exploded perspective view of the assembly of FIG. 3. As shown in FIGS. 3 and 4, pin 90 extends through plug 92 and holes 94 in annular piston 96. Thus the plug 92 and annular piston 96 form a piston of an area equal to the combined area of plug 92 and the annular area of piston 96. When this area is subjected to hydraulic fluid under pressure, the piston comprised of plug 92 and piston 96 will move member 98, pressing against the top of a valve stem such as valve stem 30 of FIG. 1, downward until annular piston 96 bottoms out against fixed stop 100, which sets the first lift of the engine valve. For the second, larger lift, a control valve such as control valve 62 of FIG. 1 will apply pressure from the high pressure rail through opening 102. This moves ball 104 upward (FIG. 3) against the check stop 106, having ports 108 therein to allow free hydraulic fluid communication with the bottom surface of plug 92. This forces member 98 downward with a relatively large stroke, limited in this embodiment by pins such as pins 70 of the embodiment of FIGS. 1 and 2 and the dashpot arrangement thereof to limit engine valve velocity as it approaches full lift.

When the engine valve is to be closed, the respective actuator couples port 102 to the vent or drain. Now the upward motion of member 98 and the resulting flow forces cause ball 104 to seat as shown in FIG. 3. However, so long as the top edges 110 of member 98 are below openings 112, the hydraulic fluid is free to flow out of vent port 114. But when the top edge of member 98 moves above port 112, flow is restricted to the flow restrictor port 116, forming a dashpot to decelerate member 98 and the closing engine valve to limit the seating velocity of the engine valve. Thus ball 104 acts as a check valve, essentially providing the same function as schematically illustrated for check valve 68 in FIGS. 1 and 2.

Now referring again to FIGS. 3 and 4, it is to be noted that the piston providing the shorter engine valve lift comprising annular piston 96 and plug 92 has a larger hydraulic area than member 98 which provides the greater lift to the engine valve. Such a configuration may have advantages in the case of exhaust valve actuation, in that for the smaller lift, the shorter stroke piston comprising annular piston 96 and plug 92 may be pressurized, or for the greater lift, the area above member 98 may be pressurized, or both the area over member 98, and the area over annular piston 96 and plug 92, may be pressurized, depending on engine operating conditions. By way of example, a diesel truck engine may be operating at a substantial rpm but not pulling hard, in which case the greater valve lift may be desired for better engine aspiration, though because combustion chamber pressures are not as high as they could be, pressurizing the region over member 98 may be adequate for opening the exhaust valves against the remaining combustion chamber pressure. On the other hand, if the same engine is pulling hard, one might pressurize both regions, gaining the advantage of the greater area of annular piston 96 and plug 92 to initiate exhaust valve opening against the higher combustion chamber pressure, with the pressure over member 98 continuing to open the engine valve to the greater lift. Consequently, operation of the system may not simply be a question of either/or, but rather, a question of either/or or both, depending on engine operating conditions.

In a preferred embodiment, the system is operated by either pressurizing the region over annular piston 96 and plug 92 for the shorter lift, or both the region over annular piston 96 and plug 92 and the region over member 98 for the larger lift, but not just the region over member 98 alone. While this is not a limitation of the invention, it provides better performance of a specific embodiment, and has the advantage of always providing a rapid engine valve opening by always providing the maximum initial engine valve opening force.

Figure 5:
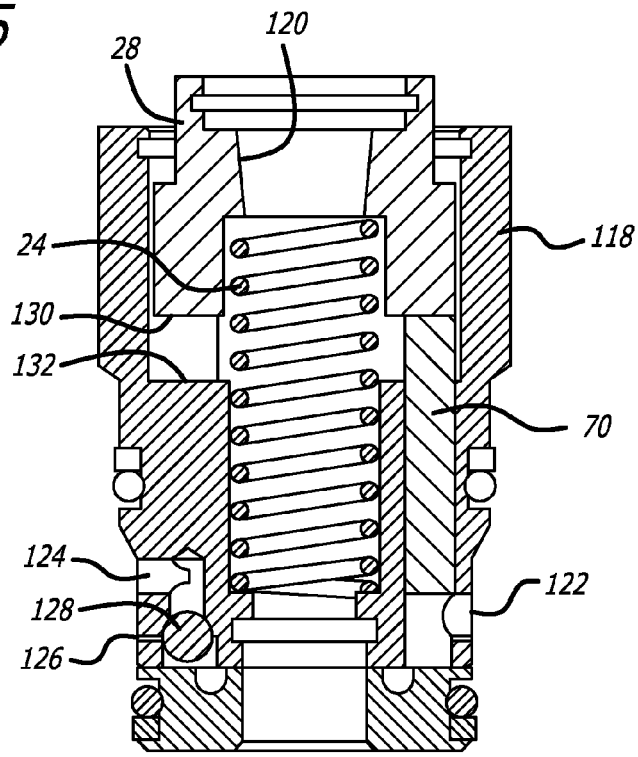
FIG. 5 is a cross section of an apparatus for providing the unidirectional dashpot and hard stop for an engine valve at its maximum lift.

Now referring to FIG. 5, a cross section of one embodiment for providing the dashpot deceleration of an engine valve for the larger lift may be seen. As may be seen in FIGS. 1 and 5, pins 70 (3 in a preferred embodiment) operate within body member 118, and act against member 24 having a tapered opening 120 for receipt of the keepers 32 (FIG. 1), member 24 being encouraged upward to the engine valve closed position by spring 24. Ports 122, 124 and 126 are coupled to the high pressure rail 48. When the engine valve is opening to its maximum lift, pins 70 are forced downward, pumping hydraulic fluid back to the high pressure rail through port 122 and orifice 126, the flow forces forcing ball 126 to seat to close off port 124. However, toward the maximum engine valve lift, one of pins 70 will start to block port 122, progressively reducing the flow area from that of the combination of port 122 and orifice 126 to simply the flow area of orifice 126, thereby providing the dashpot action for decelerating the engine valve to a soft landing at the fixed stop at maximum lift. In that regard, the fixed stop in this embodiment is provided by the contact of surfaces 130 and 132, which contact just before the pins 70 otherwise would have themselves bottomed out. Of course on coupling the engine valve actuating pistons to the drain or vent 60, pressure under pins 70 will decrease, forcing ball 128 downward to open port 124 for rapid acceleration of the engine valve toward the engine valve closed position.

Figure 6:
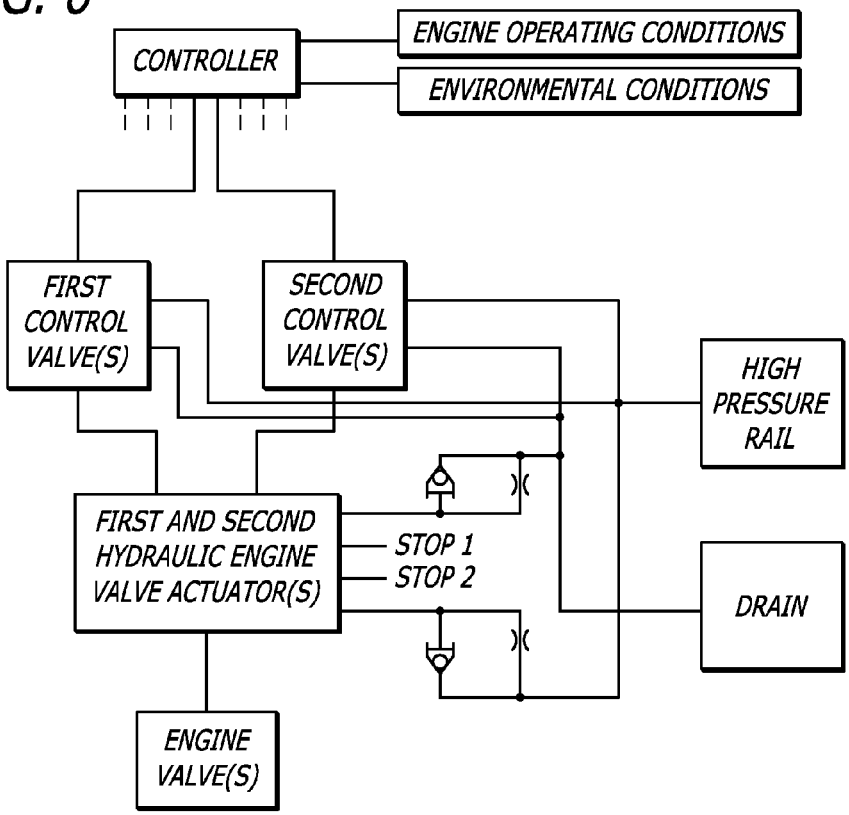
FIG. 6 is a block diagram of a hydraulic engine valve control system in accordance with an embodiment of the present invention.

An overall system generally in accordance with a preferred embodiment of the present invention may be seen in FIG. 6. As shown therein, a controller, typically a processor based controller controlling the operation of all engine valves as well as perhaps other devices, such as fuel injectors, controls the first and second control valves, which may be single stage valving systems such as described with respect to FIG. 1, or two stage valving systems such as described with respect to FIG. 2. The controller is normally responsive to engine operating conditions and environmental conditions. The first and second control valves control first and second hydraulic engine valve actuators, the first hydraulic engine valve actuator in the preferred embodiment having a fixed or hard stop at stop 1 to define a first lift and a second hydraulic engine valve actuator having a fixed or hard stop at stop 2 to define a second, greater lift, with a single action or unidirectional dashpot providing deceleration of the engine valve as it approaches the maximum lift, and as the engine valve approaches the engine valve seated position when returning from maximum lift.

It should be noted that many engines have multiple exhaust valves or multiple intake and exhaust valves. In such cases, separate hydraulic control valves and actuators may be used for each valve of each cylinder to provide independent selection of lift for each valve, or the same control valves may be used to control all hydraulic engine valve actuators for all valves of the same type (intake or exhaust) for a particular cylinder. As a still further alternative, all valves of the same type may be mechanically coupled so that a single set of control valves may be used to control a single set of hydraulic engine valve actuators to control all valves of the same type for a particular cylinder. These and other variations and combinations of these and other variations will be obvious to those skilled in the art.

In the previously described embodiments, two specific engine valve lifts could be selectively achieved, each being defined by a hard stop, with at least the greater lift having a dashpot type damping or deceleration of the engine valve, both upon approaching the maximum lift position and upon approaching the closed position, the dashpots being unidirectional dashpots allowing rapid engine valve movement away from either the engine valve closed position or the maximum lift position of the engine valve. However the aspect of the invention providing this dashpot damping is also applicable to hydraulic engine valve actuation systems having a single hard stop defined lift, such as by way of example, systems using a pair of pistons for initial engine valve opening, after which a single drive piston continues to move the engine valve to its full lift position. The dashpot damping at the full lift position may be provided in such systems, by way of example, using the structure of FIG. 5. For providing the dual piston arrangement with the unidirectional dashpot at the engine valve closing position, a cross-section of such a hydraulic actuator may be seen in FIG. 7. Here an annular boost piston 138 is mounted within a cylinder defined by member 136, the cylinder being closed at the top by member 140. Fitting within the annular boost piston 138 is a drive piston 142, the lower end of which is configured to rest on the upper end of an engine valve stem. In this embodiment, ports 144 are controllably coupled to a high pressure rail for engine valve actuation purposes, or to a vent or drain to allow return of the engine valve to the engine valve closed position such as by the combination of an engine valve return spring and pins 70 (FIG. 5). Fitting within the drive piston 142 is a check valve ball 146, being confined to a limited motion by pin 148.

To open the engine valve, the high pressure rail is coupled to ports 144. This couples the high pressure through ports 150 in the annular boost piston 138 and openings 152 in the drive piston 142, forcing ball 146 off the seat to allow free flow of the high pressure hydraulic fluid to the region above a drive piston 142 and the annular boost piston 138, forcing the combination of the two pistons downward to initiate opening of the engine valve. After initial downward movement of the boost piston 138, land 158 of the boost piston moves downward to also allow flow around the upper part of the boost piston. When flange 154 on the lower end of the annular boost piston 138 hits stop 156, the annular boost piston stops moving, though the drive piston 142 continues its downward motion to open the engine valve to its full lift open position, an assembly such as that of FIG. 5 providing both the unidirectional dashpot deceleration of the engine valve as it approaches its maximum lift, and the hard stop defining the maximum lift.

Figure 8:
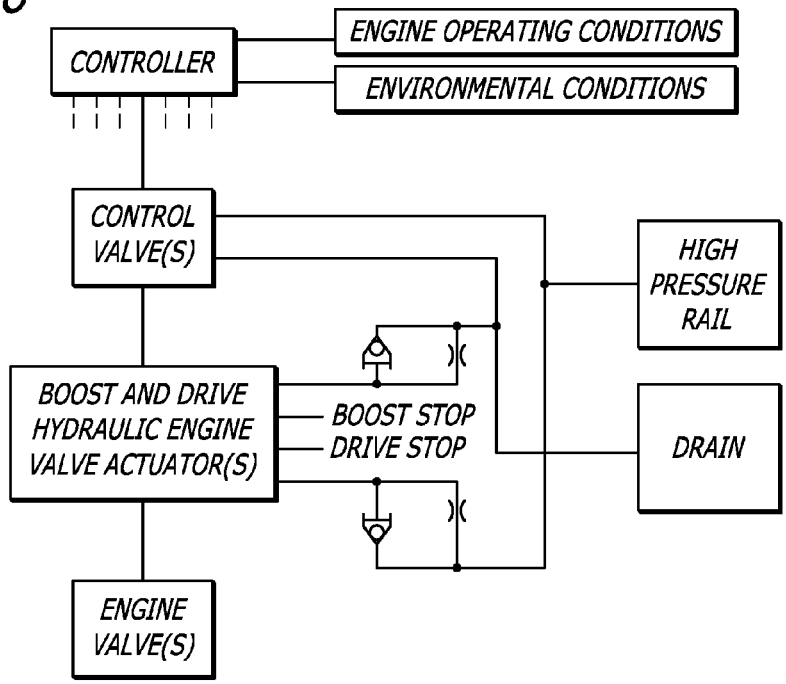
FIG. 8 is a block diagram of a hydraulic engine valve control system in accordance with a single lift embodiment of the present invention having a hard stop at maximum engine valve lift and unidirectional dashpot damping at both extremes of engine valve movement.

For valve closure, ports 144 are coupled to a vent or drain. Now the drive piston 142 is forced upward by the combined forces of the engine valve return spring and the hydraulic return on the engine valve through pins 70 (FIG. 5). Thus the drive piston 142 moves upward through the annular boost piston 138 until the enlarged portion of the drive piston contacts flange 154 on the annular boost piston 138 as shown in FIG. 8, after which the annular boost piston will move upward with the drive piston 142. During the upward motion of the drive piston 142, the flow forces force ball 146 onto the seat as shown, blocking flow through port 152. As flange 158 begins to pass ports 144, flow around the upper portion of the annular boost piston 138 and then through ports 144 to the drain reduces and is ultimately closed off, reducing the flow path out of region 160 above the two pistons to that of orifice 162, thereby providing the dashpot type deceleration of the assembly, and particularly the engine valve, to a soft landing on closure.

Figure 7:
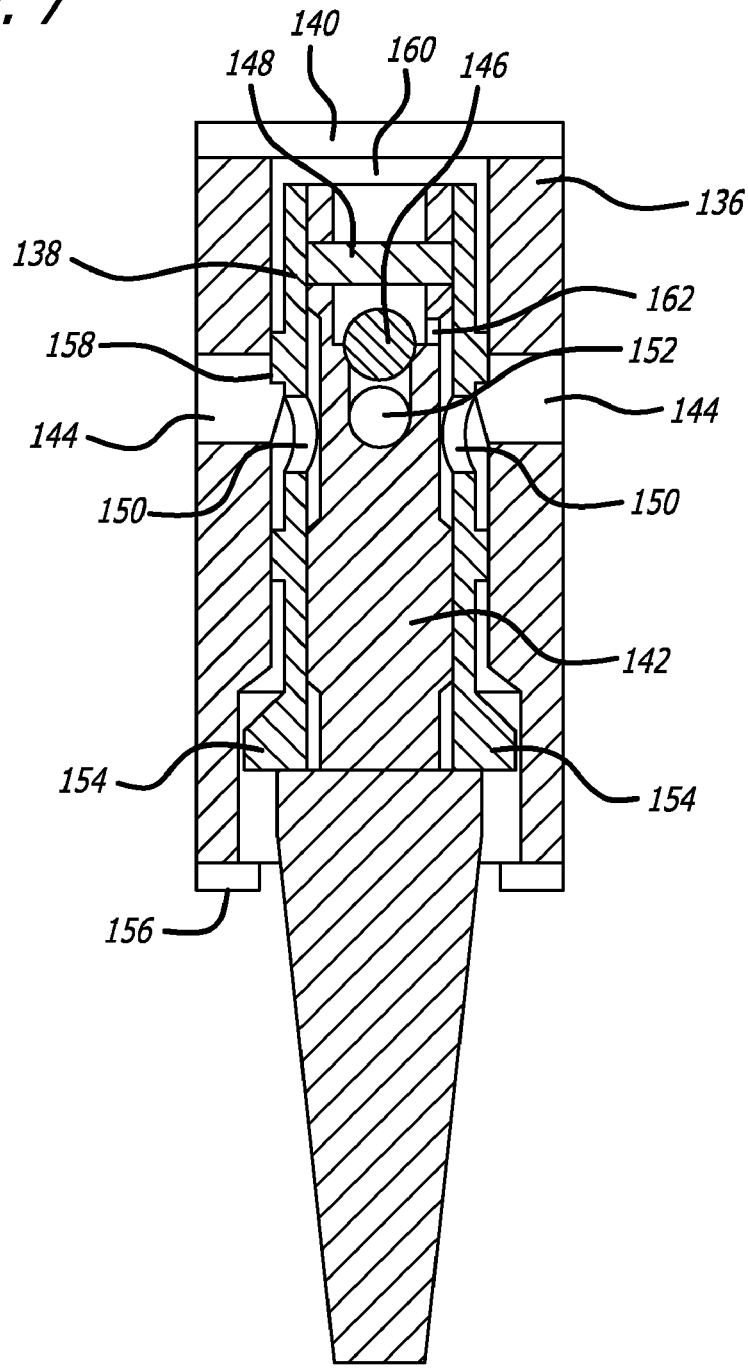
FIG. 7 is a cross section of an apparatus for providing the unidirectional dashpot for an engine valve as an engine valve approaches the engine valve closed position in a single lift system.

An overall system generally in accordance with the single lift embodiment hereinbefore described with respect to FIG. 7 may be seen in FIG. 8. Here, only a single control valve or two stage control valves are used to controllably couple the high pressure rail to the boost and drive hydraulic engine valve actuators or to couple the boost and drive hydraulic engine valve actuators to a low pressure drain. In this Figure, the separate boost piston stop and drive piston stop are shown with unidirectional dashpots being active as the engine valve approaches the maximum engine valve lift, as well as when the engine valve approaches the engine valve closed position.

While certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A hydraulic engine valve actuation system comprising:

a first hydraulic actuator configured to actuate an engine valve between an engine valve closed position and a first lift, the first lift being defined by a fixed stop associated with the first hydraulic actuator;

a second hydraulic actuator configured to the engine valve between an engine valve closed position and a second lift, the second lift being defined by a fixed stop associated with the second hydraulic actuator, the second lift being greater than the first lift;

first control valving coupled to the first hydraulic actuator to controllably hydraulically couple the first hydraulic actuator to a source of hydraulic fluid under pressure or to a hydraulic drain;

second control valving coupled to the second hydraulic actuator to controllably hydraulically couple the second hydraulic actuator to a source of hydraulic fluid under pressure or to the hydraulic drain;

a unidirectional dashpot operative only when engine valve approaches the second lift to limit engine valve velocity as the engine valve approaches the second lift; and a unidirectional dashpot operative only when engine valve approaches the closed position to limit engine valve velocity as the engine valve approaches the engine valve closed position from the second lift.

2. The hydraulic engine valve actuation system of claim 1 wherein the first and second control valving is electromagnetically controlled single stage valving.

3. The hydraulic engine valve actuation system of claim 1 wherein the first and second control valving is two stage valving using an electromagnetically controlled valve for each first stage and a hydraulically controlled valve for each second stage.

4. The hydraulic engine valve actuation system of claim 1 further comprising a controller coupled to control the first and second control valving responsive to engine operating conditions.

5. The hydraulic engine valve actuation system of claim 4 wherein the controller is also coupled to be responsive to engine operating conditions.

6. A hydraulic engine valve actuation system comprising:

a first hydraulic actuator configured to actuate a first engine valve between an engine valve closed position and a first lift, the first lift being defined by a fixed stop associated with the first hydraulic actuator;

a second hydraulic actuator configured to actuate the first engine valve between an engine valve closed position and a second lift, the second lift being defined by a fixed stop associated with the second hydraulic actuator, the second lift being greater than the first lift;

first control valving coupled to the first hydraulic actuator to controllably hydraulically couple the first hydraulic actuator to a source of hydraulic fluid under pressure or to a hydraulic drain;

second control valving coupled to the second hydraulic actuator to controllably hydraulically couple the second hydraulic actuator to a source of hydraulic fluid under pressure or to the hydraulic drain;

a controller coupled to control the first and second control valving responsive to engine operating conditions;

a unidirectional dashpot operative only when engine valve approaches the second lift to limit engine valve velocity as the engine valve approaches the second lift; and a unidirectional dashpot operative only when engine valve approaches the closed position to limit engine valve velocity as the engine valve approaches the engine valve closed position from the second lift.

7. The hydraulic engine valve actuation system of claim 6 wherein the first and second control valving is electromagnetically controlled single stage valving.

8. The hydraulic engine valve actuation system of claim 6 wherein the first and second control valving is two stage valving using an electromagnetically controlled valve for each first stage and a hydraulically controlled valve for each second stage.

9. The hydraulic engine valve actuation system of claim 6 wherein the controller is also coupled to be responsive to engine operating conditions.

10. The hydraulic engine valve actuation system of claim 6 further comprised of:

a third hydraulic actuator configured to actuate a second engine valve in the same cylinder as the first engine valve between an engine valve closed position and the first lift, also defined by a fixed stop associated with the third hydraulic actuator;

a fourth hydraulic actuator configured to actuate the second engine valve between an engine valve closed position and the second lift, also defined by a fixed stop associated with the fourth hydraulic actuator;

the first control valving also being coupled to the third hydraulic actuator to also hydraulically couple the third hydraulic actuator to the source of hydraulic fluid under pressure or to the hydraulic drain;

the second control valving also being coupled to the fourth hydraulic actuator to hydraulically couple the fourth hydraulic actuator to the source of hydraulic fluid under pressure or to the hydraulic drain.

* * * * *